US008847057B2

(12) United States Patent
Koah

(10) Patent No.: US 8,847,057 B2
(45) Date of Patent: Sep. 30, 2014

(54) AUDITORY BOARD

(71) Applicant: John Koah, Hermosa Beach, CA (US)

(72) Inventor: John Koah, Hermosa Beach, CA (US)

( * ) Notice: Subject to any disclaimer, the term of this patent is extended or adjusted under 35 U.S.C. 154(b) by 0 days.

(21) Appl. No.: 13/899,423

(22) Filed: May 21, 2013

(65) Prior Publication Data

US 2013/0305910 A1 Nov. 21, 2013

Related U.S. Application Data

(60) Provisional application No. 61/688,836, filed on May 21, 2012.

(51) Int. Cl.
*G10H 1/34* (2006.01)

(52) U.S. Cl.
USPC ..... 84/615; 84/653; 84/723

(58) Field of Classification Search
USPC ..... 84/615, 653, 723
See application file for complete search history.

(56) References Cited

U.S. PATENT DOCUMENTS

| | | | | | |
|---|---|---|---|---|---|
| 3,749,810 | A * | 7/1973 | Dow | 84/701 |
| 3,865,001 | A * | 2/1975 | Hershey | 84/723 |
| 3,922,944 | A * | 12/1975 | Kurosaki et al. | 84/721 |
| 4,121,488 | A * | 10/1978 | Akiyama | 84/720 |
| 4,245,539 | A * | 1/1981 | Jones | 84/672 |
| 4,491,050 | A * | 1/1985 | Franzmann | 84/746 |
| 4,720,789 | A * | 1/1988 | Hector et al. | 463/33 |
| 4,852,443 | A * | 8/1989 | Duncan et al. | 84/733 |
| 4,955,276 | A * | 9/1990 | Feldman et al. | 84/403 |
| 5,017,770 | A * | 5/1991 | Sigalov | 250/221 |
| 5,081,896 | A * | 1/1992 | Hiyoshi et al. | 84/600 |
| 5,369,270 | A * | 11/1994 | Gurner et al. | 250/221 |
| 5,414,256 | A * | 5/1995 | Gurner et al. | 250/221 |
| 5,442,168 | A * | 8/1995 | Gurner et al. | 463/36 |
| 5,803,835 | A * | 9/1998 | Moton et al. | 473/414 |
| 5,837,952 | A * | 11/1998 | Oshiro et al. | 200/86 R |
| 5,910,355 | A * | 6/1999 | Burgess | 428/209 |
| 5,920,024 | A * | 7/1999 | Moore | 84/609 |
| 6,110,073 | A * | 8/2000 | Saur et al. | 482/8 |
| 6,329,620 | B1 * | 12/2001 | Oishi et al. | 200/86.5 |
| 6,410,835 | B2 * | 6/2002 | Suzuki et al. | 84/464 R |
| 6,450,886 | B1 * | 9/2002 | Oishi et al. | 463/36 |
| 6,628,265 | B2 * | 9/2003 | Hwang | 345/156 |
| 6,743,971 | B1 * | 6/2004 | Chen | 84/746 |
| 6,758,753 | B1 * | 7/2004 | Nagata et al. | 463/36 |
| 7,402,743 | B2 * | 7/2008 | Clark et al. | 84/615 |
| 7,645,211 | B1 * | 1/2010 | Thomeczek et al. | 482/1 |
| 7,722,501 | B2 * | 5/2010 | Nicolas et al. | 482/1 |
| 7,938,751 | B2 * | 5/2011 | Nicolas et al. | 482/1 |
| 8,246,521 | B2 * | 8/2012 | Alexander et al. | 482/8 |
| D680,502 | S * | 4/2013 | McMillen | D13/164 |
| 8,408,910 | B2 * | 4/2013 | Holljes | 434/29 |
| 8,431,811 | B2 * | 4/2013 | Riopelle | 84/615 |
| 8,445,771 | B2 * | 5/2013 | Sakazaki | 84/743 |
| 2001/0004861 | A1 * | 6/2001 | Suzuki et al. | 84/609 |
| 2007/0000374 | A1 * | 1/2007 | Clark et al. | 84/724 |

(Continued)

*Primary Examiner* — David S. Warren
(74) *Attorney, Agent, or Firm* — Robert J. Lauson, Esq.; Lauson & Tarver LLP

(57) ABSTRACT

A planar surfaced electrical musical instrument is provided which is configured to support both feet of a user standing upon it during use. Supported by the device, the standing user may generate sound, such as drums, through a contact of one or both feet with the planar upper surface which is in operative contact with electronic signal generating components which generate an electronic signal correlating to vibrations emanating from the contact point of the user's foot with the planar surface.

12 Claims, 4 Drawing Sheets

(56) References Cited * cited by examiner

U.S. PATENT DOCUMENTS

| | | | | |
|---|---|---|---|---|
| 2013/0152768 | A1* | 6/2013 | Rapp | 84/634 |
| 2013/0305910 | A1* | 11/2013 | Koah | 84/730 |
| 2014/0190266 | A1* | 7/2014 | Strozier | 73/658 |

AUDITORY BOARD

FIELD OF THE INVENTION

This application claims priority to U.S. Provisional application Ser. No. 61/688,836 filed on May 21, 2012, which is incorporated herein in its entirety by this reference thereto.

The present device relates to musical instruments and percussion instruments. More particularly, the disclosed device and method, relates to a planar surfaced electrical musical instrument configured to support both feet of a user concurrently, which is employable to generate sound, such as drums, using one or a plurality of sensors or electronic signal generating components that generate an electronic signal when one or both feet of the user, impact the planar surface. Operatively employing the device herein, a user may generate music with either or both feet, concurrently or independently, while standing or sitting.

BACKGROUND OF THE INVENTION

Entertainers presenting live music performance frequently do so in groups of musicians. In the group setting, each has an instrument which is played to generate a portion of the music. More often than not, such a group will have a drummer to provide the rhythm and beat which audiences expect in a live performance, especially if there is dancing.

Further, many musicians play their instruments while tapping or moving their feet to the rhythm simultaneously. Such body movements with the feet and legs are in fact common among musicians and non-musicians alike who tap their feet and move their legs in accompaniment and in concurrence with the music in which they are playing, or in which they are hearing. The present invention provides a means for allowing this accompaniment and time-keeping motion of people, for the purpose of music creation.

While the performance of live music, with it's expected beat and percussion is easily accomplished by a plurality of musicians where one is a drummer, for the solo musician without an accompanying drummer a quandary arises. While guitars, vocals, and other melodic instruments have a pleasant sound, and can be combined for performances, many individuals and smaller musical groups without drums are often precluded from performing in certain musical venues which require the pulse and beat of loud, present, rhythmic percussion for their audiences. The present invention solves this quandary by allowing a performer to accompany themselves on percussion, while playing a secondary instrument with the hands.

While some solo artists and small groups can employ a drum machine, or recorded drum tracks with amplified music which the group accompanies, there are a number of problems with this scenario. First, many audiences are simply turned off by the lack of a live drummer. This may be because a live audience generally will request certain songs be played and not necessarily in any real order. Consequently for the group or band using recorded drums, it is hard to anticipate and accommodate such out of order musical performances and to incorporate the recorded tracks from electronic memory correctly if at all.

Attempts at remedying the shortfalls of conventional art have been presented, for example electronic drum machines of the kind disclosed in U.S. Pat. No. 4,479,412. Such devices conventionally playback stored samples or digital recordings of percussive sounds. However, employment of such devices is often impractical for use in live musical performance by a single performer, because they require the user to employ their hands for normal operation. Additionally, because such devices employ prerecorded drum recordings they do not allow the musician the flexibility to instantly adjust tempo, nor do they allow the performer to spontaneously alter rhythm signatures or musical song selection in mid-performance, should the desire arise. Further, a performer playing their instrument with their hands, cannot use their hands to attempt to simultaneously alter tempo or rhythm instructions or to alter recordings on a drum machine.

As such, there is an unmet need for a musical device which allows a musician playing a hand manipulated instrument, to include a percussion instrument sound with their live music. Such an instrument or device, when employed, should not only produce percussion sounds to the live music being played, it should also allow for an instant tempo adjustment, or a spontaneous alteration of rhythm signatures and/or musical song selection in mid-performance, should the desire or need arise. Finally, such an instrument should provide the cure to these noted shortfalls of conventional art in a manner which does not require the artist to remove or reposition their hands from the instrument they are already playing.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

OBJECTS OF THE INVENTION

It is an object of the present invention to allow a person to make use of one of their most natural rhythmic time-keeping motions, the tapping of their feet, to create an accompaniment for their music easily.

It is an additional object of this invention to allow tapping of one foot to produce sounds from different instruments than tapping of the other of their two feet.

It is another object of the present invention to provide a musical instrument which is planar in shape, replicating the floor, configured structurally to accommodate the full weight of a user to stand upon its surface with both feet substantially level, in a natural position for standing or sitting, and to amplify and modify sound emitted from the device when the planar surface is impacted.

SUMMARY OF THE INVENTION

In accordance with the purposes of the present invention, as embodied and broadly described herein, the present invention provides a means for a musician playing music on a hand-operated instrument, to generate concurrent drum and percussion sounds, through the tapping of their feet on a planar surface adapted to support their weight, to create an accompaniment for their music.

The disclosed device, employing a percussive actuation and transmission surface, which is dimensioned sufficiently broad and sturdy to support the user's entire weight communicated by both feet on a planar surface of the device. The planar surface is sized to allow the user to safely and comfortably stand on it with both feet fully in contact with the planar surface in an as-used, static position. A sufficient planar surface in an annular ring or perimeter area surrounding a central area occupied by the user's feet is also provided so the user is afforded a reasonable range of movement forward and aft, and to the right and to the left of the initial respective foot position of each foot in the central area. This provision of a central area and perimeter insures the user is able to maintain full contact with the planar surface across their foot bottom while in the central area, and that they are able to tap on the planar surface, either in the central area or the perimeter area, depending on their personal style and body movements, and maintain their balance.

In a primary mode of the device, the acoustic properties of the planar actuation surface are such that acoustic vibrations generated by one or both feet of the user, impacting the planar surface, are efficiently transmitted throughout the device to one or more electronic signal generating components operatively positioned to be in a communication with the planar surface. In this simplest mode of the device, with the planar surface sized to accommodate the user with the central and perimeter areas, where only one instrument is being activated by foot tapping or similar contact with the planar surface, there is no need for precise foot positioning or impacting to actuate the device with either or both feet. In modes of the device where one foot may activate a sound, and the other a separate distinct sound, for example two types of drums, acoustical isolation can be achieved by positioning a dampening material in-between underlying electronic signal generating components for the right and left sides respectively. In modes where more than two different instruments or instrument types are being activated, somewhat more precise tapping may be required, and an increase in the perimeter area of the planar surface may also be provided to allow more and quicker movements and insure contact with the planar surface during such.

In a preferred form of the device, the electronic signal generating components, such as one or a plurality of transducers, are operatively attached to the device in positions underlying the planar surface, or are embedded in the substantially planar surface used for foot contact and activation by the user. The transducer so positioned captures and converts the acoustic and vibrational energy of the user's foot contacting the planar actuation surface into an electronic signal suitable for further transmission and manipulation. The output of these transducers may be ganged together, or may be processed independently.

The device may contain one or more electronic control features which allow the user to perform various operations such as turning the device off and on, selecting various sounds and modes of operation, etc. Further, a video display component, or touch screen, may be contained within or upon the device as a visual means for a user to ascertain the modes of operation, and/or status of the device, and aids in selecting the modes of operation.

In a preferred mode of the device, electronic components adapted for providing a signal conditioning and processing stage is provided which allows a user to perform desirable and useful manipulations of the transducer or other signal generator outputs. One such function may be noise reduction or signal threshold limiting so that acoustic vibrations created by inadvertent user motions when their feet contact the planar surface, or other spurious sources, are suppressed. Another such function may be to adjust the transducer output amplitude or frequency spectrum for optimal input to an analog sound system. Another such function may be to convert the transducer output from analog to digital for input to a musical instrument digital interface (MIDI) and/or a digital waveform generator. A further such function may be the changing of sounds and controlling of volume of the output, based on the velocity of contact with the planar surface and resulting output voltages of the signal generating devices.

An optional digital waveform storage and transmission device which uses the output of the signal conditioning and processing stage to trigger the transmission of digitally synthesized and/or sampled sound waveforms may also be included. This output signal is adapted to provide an input to an operatively engaged sound creation device, such as a musical amplifier and/or speaker system which converts the received input signal into audible sound.

In a preferred mode of the device, a top planar surface and other components of the chassis are formed of a material which conducts vibration and sound well and communicates it to the operatively engaged signal generating components, such as wood or plastic. Because the planar top surface of the device herein is at least large enough to allow a user to stand in a natural stance with both feet supported by the continuous planar surface from heel to toe, and surrounded by a perimeter area, great utility is provided. The user's ability to use the toe portions, heel portions, and entire foot portions, of both feet concurrently while standing on the planar surface, to generate the output signal used for percussion, without having to look at the planar surface or worry about balance, thereby allows the user to use both hands and to concentrate on playing their hand-operated instrument. Additionally, perimeter area of the planar surface surrounding central area occupied by the feet of the user, allow for lateral movement such as for heel or toe tapping and as such, is preferred.

In another manner for output signal attenuation through the adjustment of the signal generated by the sensing components, the interior of the device between the planar top surface may be chambered to accommodate the operative positioning of the signal generating components such as the noted transducers. Alternatively the interior area of the chassis may be divided, or vibrationally sectioned, into different interior compartments. Such will then allow for foot or other contact with the planar top surface in communication with each respective compartmentalized signal generating device, to be perceived and translated differently. This separation and activation of differing instruments can be provided and also enhanced by the choice of location of the signal generating components, the physical separation thereof, inclusion of dampening material in between signal generating components, and enabled by software and relays and filters and the like, adapted to the task.

Should the device require onboard electrical power for functioning in any mode herein, such may be communicated in a conventional fashion with cables from AC power or adapter, or using onboard electrical storage such as batteries.

With respect to the above description, before explaining at least one preferred embodiment of the herein disclosed invention in detail, it is to be understood that the invention is not limited in its application to the details of construction and to the arrangement of the components in the following description or illustrated in the drawings. The device herein described and disclosed in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other planar two-footed triggering and music generation structures, methods and systems for carrying out the several purposes of the present disclosed device. It is important, therefore, that the claims be regarded as including such equivalent construction and methodology insofar as they do not depart from the spirit and scope of the present invention.

It is an object of the present invention to allow a person to make use of one of their most natural rhythmic time-keeping motions, the tapping of their feet, to create accompaniment music easily, while employing their hands to play a separate instrument.

It is another object of the present invention to provide a musical instrument which is planar in shape, replicating the floor, configured to allow a user to stand upon it's surface with both feet level, in a natural position for standing or sitting, and to amplify and modify sound emitted from the device when the planar surface is impacted.

These and other objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only nor exclusive examples of embodiments and/or features of the disclosed device. It is intended that the embodiments and figures disclosed herein are to be considered illustrative of the invention herein, rather than limiting in any fashion.

DETAILED DESCRIPTION OF THE INVENTION

Figure 1:
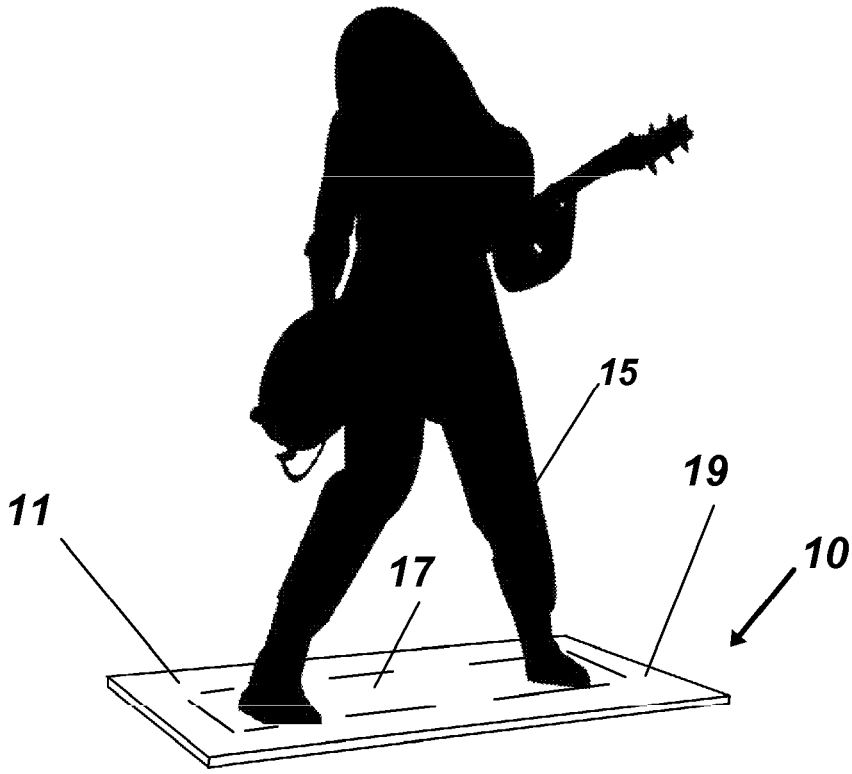
FIG. 1 depicts a musical performer standing in an operative position with both feet positioned in a central area of a planar surface of the device.

Now referring to drawings in FIGS. 1-9, wherein similar components are identified by like reference numerals, there is seen in FIG. 1, the device configured with a top planar surface 11, having a central area 17 sized to accommodate both feet of a standing user 15 in a static position in the as-used mode of the device 10, ready for contact of the feet with the planar surface 11. Shoes in the United States for adults range from approximately 8 inches to 15 inches in length depending on the respective shoe size of the individual. Consequently a central area 17 of substantially 15 to 16 inches will accommodate most user's shoed feet.

A perimeter area 19 surrounding this central area 17 of planar surface 11 is also preferably provided such that the user 15 standing in the central area 17 is balanced on both feet, and comfortable, and the user 15 may tap or contact the planar surface 11 in the central area 17 during use, or if lateral movement is favored by the user 15, they may contact the planar surface 11 in the perimeter area 19. Many users 15 may tap the planar surface 11 directly under their respective foot, however many may tend to tap in a lateral direction from the original position, or change for some types of music, and thus both the central area 17 and perimeter area 19 are preferred.

A current total size configured to the disclosed purpose, which experimentation has shown to work well, is between a width of 19 to 30 inches along an imaginary line running through both feet of the user 15, with a length dimension running perpendicular to the imaginary line, of between 10 to 20 inches. However, because users 15 come in all sizes, and have their own comfort zone for feet movement to impact the planar surface 11 with sufficient area of a planar surface 11 to maintain their balance, the device 10 may be provided in a plurality of sizes, for user choice depending on their own style of foot contact with the planar surface 11 during use. Currently a central area 17 of at least the length of the user's feet from heel to toe, as noted above as substantially 8-15 inches, would be a minimum size, and ideally at least a 4-6 inch wide perimeter area 19 can be provided.

This sizing allows most users 15 to stand with feet apart in a normal upright stance, balanced in the central area 17, while using a hand-operated instrument, and to move their feet to operate the device 10 by impacting the planar surface 11 with either or both feet and use the front, rear, or the entire foot surface of both feet individually, to contact the planar surface 11 and thereby communicate a vibration and sound therefrom to the underlying signal generating components.

Figure 2:
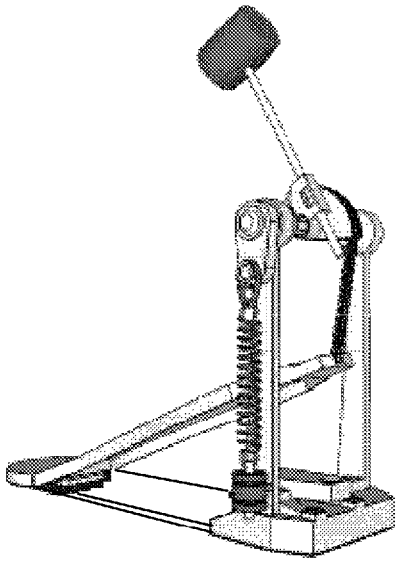
FIG. 2 (prior art)
FIG. 2 shows a prior art common acoustic bass drum pedal.

As seen in FIG. 2, the prior art in the area of employing a pedal to operate a drum while playing music with the hands is shown. Such pedals have been employed by "one man bands" concurrently with the playing of a stringed instrument to provide for a drum sound. As can be seen, the pedal has an inclined surface which only accommodates one foot, and depressing the pedal with a foot already in an inclined position, tends to throw the user off balance. In addition the user is limited to a single sound.

Figure 3:
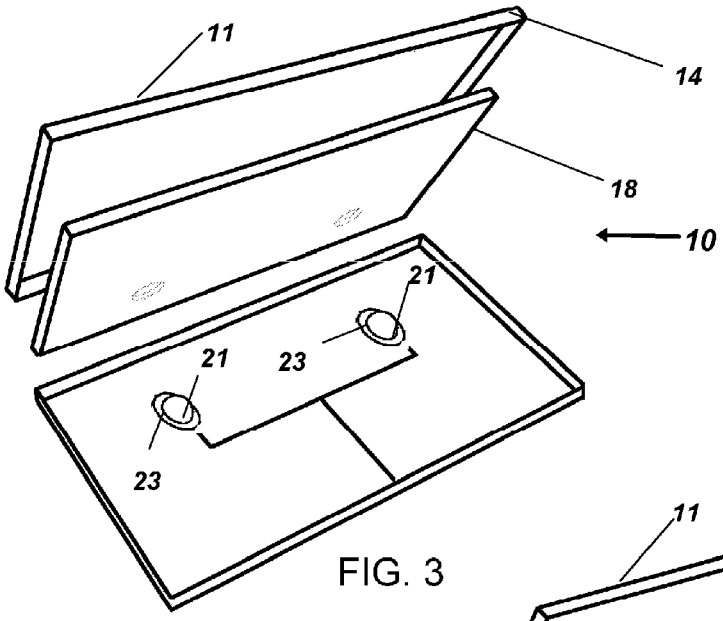
FIG. 3 shows an exemplar of an exploded view of one preferred mode of constructing the device.

In a preferred mode of the device 10 shown in FIG. 3, signal generating components 21 which may be any electronic component which will generate an output electronic signal when vibration and/or sound is communicated thereto. Such signal generating components 21 include but are not limited to, microphones, magnetic pickups such as for guitars, and piezoelectric force sensors, although others as would occur to those skilled in the art are considered within the scope of this patent.

Figure 4:
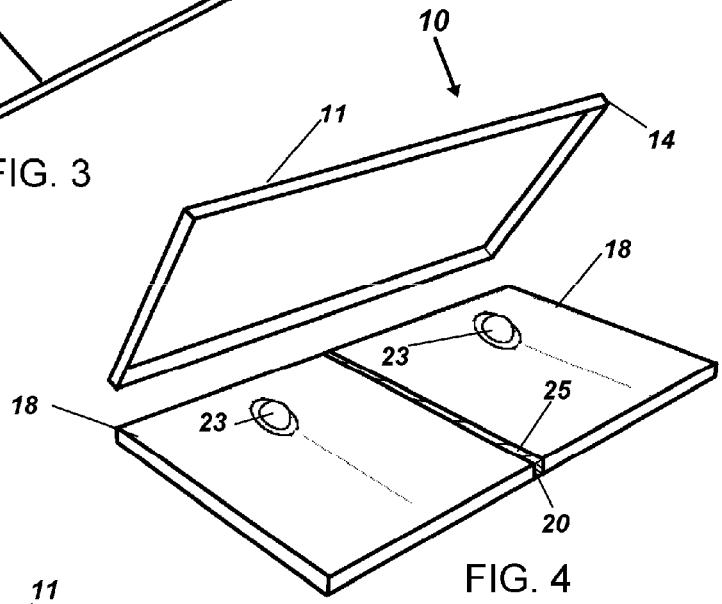
FIG. 4 depicts a mode of the device where signal generating components on the right are separated by a dampener from signal generating components on the left.
Figure 5:
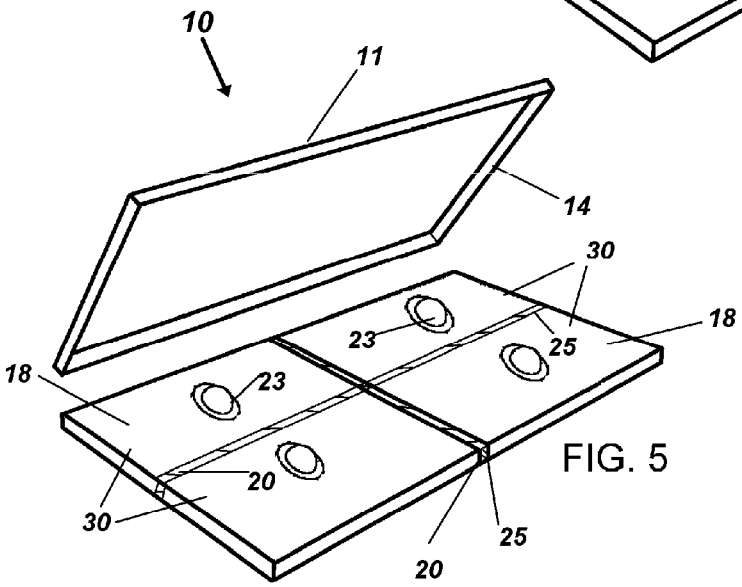
FIG. 5 depicts the device having transducers functioning as the electronic signal generating components which are positioned in quadrants which may be physically segmented from other quadrants with scoring or spacing of sections.
Figure 6:
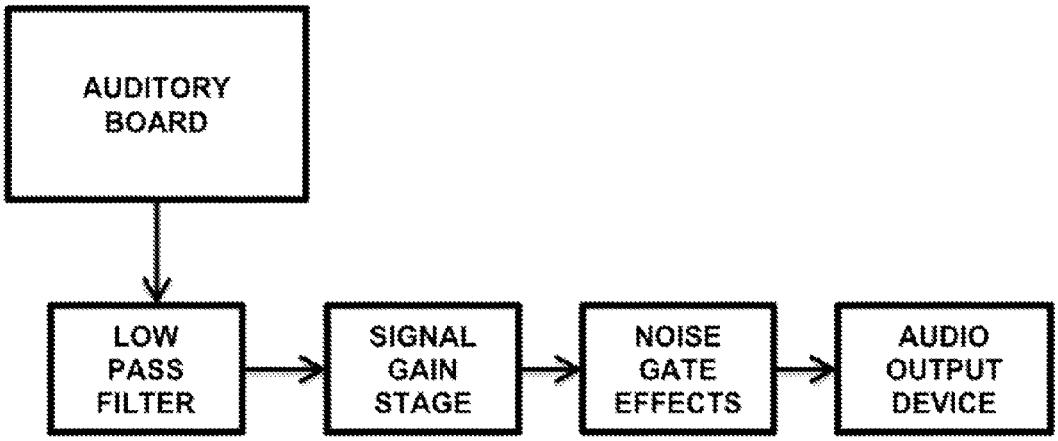
FIG. 6 is a schematic block diagram illustrating analog signal conditioning and processing stages of the device.

In FIGS. 3-5, the electronic signal generating components 23 are depicted as piezoelectric force sensors 23. In FIG. 3, the piezoelectric force sensors 21 are placed as a pair in a simple mode of the device 10, although a single piezoelectric force sensor 23 would also work in this mode. The output signal from both piezoelectric force sensors 23 are routed to a common output signal to the electronic device such as an amplifier and loudspeaker, to produce sound relative to the user's contact with the planar surface 11.

In FIG. 4 is shown a mode of the device 10, which allows the user to use each foot, by a respective contact with the planar surface 11, to generate a different sound as the plurality of piezoelectric force sensors 23 is routed to a left and right output feed. A simple separation on the piezoelectric force sensors 23 in their positionings on the underlying section 18 will produce separate outputs. However, enhanced separation can be provided by a formed gap 20 between sections of the underlying section 18. Additionally enhanced separation of the signals from the respective right and left piezoelectric force sensors 23 can be achieved by the positioning of a vibration damping material 25 in the gap 20 which impedes communication of vibration and acoustics between the two halves of the underlying section 18. Such material may be any material suited to blocking vibration from contact with one side of the planar surface 11 from being communicated to electronic signal generation devices on the opposite side. Such can include one or a plurality of materials from a group including such damping material as rubber, polymeric material, plastic material, ceramic material, fiberglass, metalized fiberglass, sorbethane, closed and open cell foam, or mixtures of these materials in combination, or other damping materials of differing durometer and damping effects to alter or reduce or increase the conductive properties for vibration and sound, in a space between sections of the top planar surface 11 and the signal generating components 21 which are all in a vibrational communication with the planar surface 11.

This two output mode of the device is a significant enhancement to the device 10 in that two different instruments, for example a bass drum, and a tom, can be controlled by the user 15 by using the right and left foot respectively. Contact by the right and left foot with portions of the top planar surface 11 in vibrational communication with the piezoelectric force sensors 23 in an underlying section 18, will thus produce separate independent signals, each of which may be routed electronically to play a separate sound.

In the mode where separation is enhanced, such as with a gap 20 and/or damping material 25, the acceleration of the user's foot contact with the top planar surface 11 can be employed to impart differing tonal and volume characteristics to the sound generated.

As shown in FIG. 5, the device 10 may employ multiple signal generators shown as piezoelectric force sensors 23 which are positioned in quadrants or sections 30 of the underlying component 18. As shown, the device 10 has signal generating components 21 such as piezoelectric force sensors 23, positioned in sections 30 formed by sectionalizing the surface of the underlying section 18, and the top section 14 forming the top planar surface. This sectioning serves to partially or fully isolate the signal generating components 21 such as piezoelectric force sensors 23, from each other and from the differing sections of the top section 14 if also separated.

In any quadrant mode of the device, a tap from one foot on the top planar surface 11 overtop a quadrant would be sufficiently vibrationally isolated from other quadrants, such that the electronic signal would be generated by the signal generating component corresponding to the tapped quadrant. Using software, or hardware adapted to the task of only communicating the strongest of a plurality of electronic signals from the signal generating components 21, at a given time, the device 10 could employ each quadrant for switching separately.

The sections 30 are not limited to four, and could be any number adapted to the task. Further, the signal generating components 21 may be mixed or matched in the sectionalized mode by mounting any of the group including microphones, piezoelectric force sensors, and magnetic pickups in individual sections 30, wired to generate distinct sounds. As noted above, FIG. 6 is a schematic block diagram illustrating operatively constructed circuits to and through other electronic components of the device. Components may include one or a combination of filters, signal gains, preamplifiers, noise reduction processes, signal limiters, analog or digital effects such as reverb or delay, or other signal processes and/or effects. The flow of the processing of the signal may be handled in any order and the depicted flow is for illustrative purposes and is not intended to limit the scope of the present invention.

Figure 7:
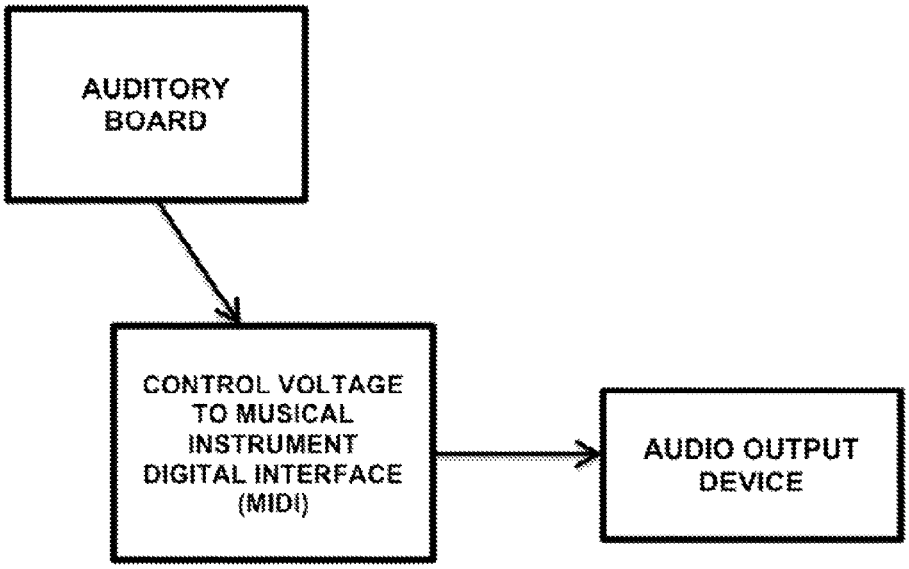
FIG. 7 shows a digital mode of processing the generated electronic signals from the transducers or other signal generators, and employing MIDI processing where velocity of impact can generate differing sounds.

FIG. 7 shows a digital mode of processing the generated electronic signals from the electronic signal generators, and employing MIDI processing for the device.

Figure 8:
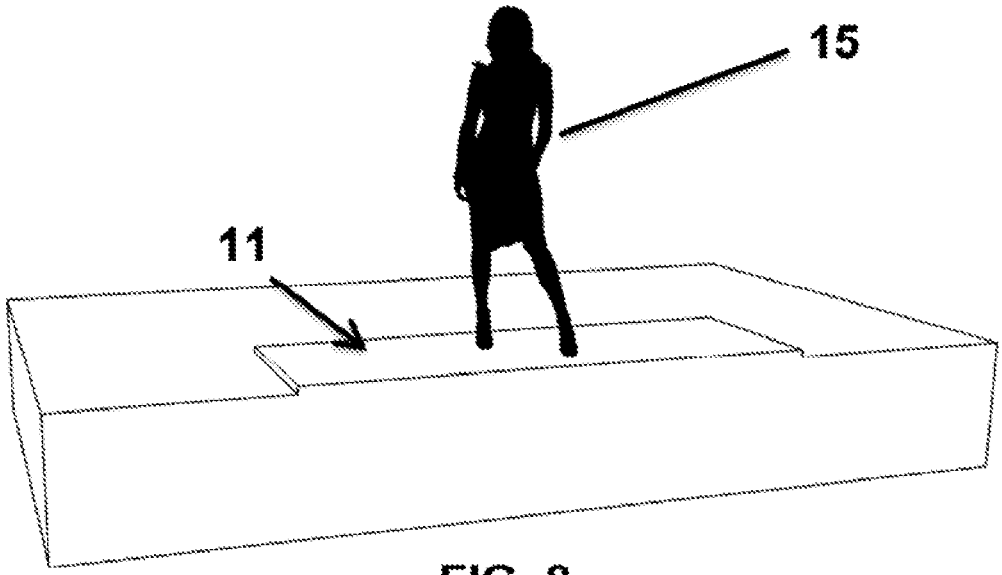
FIG. 8 depicts the device built directly into a performance stage floor.

FIG. 8 depicts the device built directly into the surface of a live performance stage. The present invention could be devised and formulated into other objects as well, such as into a guitar case.

Figure 9:
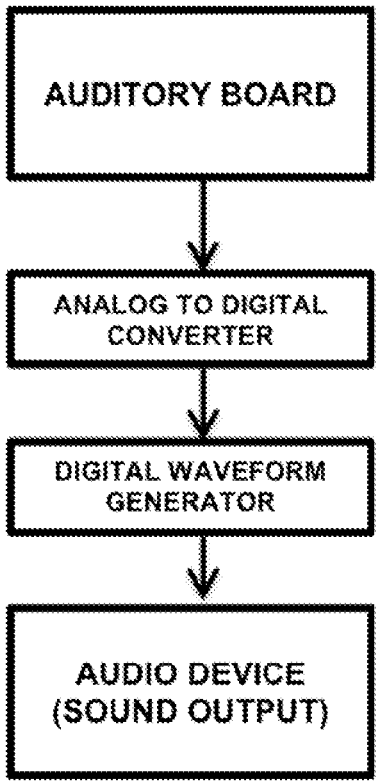
FIG. 9 depicts a schematic block diagram illustrating analog to digital signal conversion and the transmission of digitally sampled sound from the device.

FIG. 9 depicts a schematic block diagram illustrating the signal generating component's electronic signal, generated by either or both feet of the user on the top planar surface 11, directed to an analog to digital signal conversion stage and a digital waveform storage and transmission component of the device. As shown, the output of the signal processing stage is conditioned to trigger the transmission of digitally synthesized and/or sampled sound waveforms. The output of the digital waveform storage and transmission component is a signal appropriate for input to a sound creation component such as a musical amplifier and/or speaker system. Optionally, the outputted signal may be configured to be communicated by wired or wireless means from device 10.

As noted, any of the different configurations and components can be employed with any other configuration or component shown and described herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, or steps in formation of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A sound generating apparatus comprising:

a body having a vibration conductive planar surface;

said vibration conductive planar surface configured to bear a user's weight while standing thereon in an as-used position with two feet in a static position supported by a first portion of said vibration conductive planar surface;

an electroacoustic transducer in vibrational communication with said vibration conductive planar surface;

said electroacoustic transducer detecting the waveform a mechanical vibration conducted through said vibration conductive planar surface from a contact of either of said two feet with said vibration conductive planar surface, and converting said mechanical vibration to an electronic signal; and said electronic signal being communicated to an electronic sound generating system for producing a musical sound correlating to said electronic signal, wherein said user in said as-used position, may generate said musical sound by imparting a said contact to said vibration conductive planar surface through a tapping of one of said two feet against said vibration conductive planar surface or otherwise raising all or a portion of one of said two feet from said static position, and subsequently imparting a said contact to said vibration conductive planar surface.

2. The sound generating apparatus of claim 1, additionally comprising:

a length of said first portion of said vibration conductive planar surface being sized to contact across an entire bottom surface of both said two feet, or of two shoes each respectively engaged on one of said two feet.

3. The sound generating apparatus of claim 1, additionally comprising:

a plurality of said electroacoustic transducers;

a first electroacoustic transducer positioned in a first separated positioning in vibrational communication with a first portion of said vibration conductive planar surface receiving said contacts from a first foot of said two feet;

a second electroacoustic transducer eempenents positioned in a second separated positioning in vibrational communication with a second portion of said vibration conductive planar surface receiving said contacts from a second foot of said two feet;

said first electroacoustic transducer converting vibrations generated by said contact of said first foot, to a first electronic signal;

said second electroacoustic transducer converting vibrations generated by said contact of said second foot, to a second electronic signal;

said first electronic signal and said second electronic signal being communicated to said electronic sound generating system, for producing a first musical sound correlating to said first electronic signal, and producing a second musical sound correlating to said second electronic signal; and wherein said user can generate a said first musical sound by imparting a said contact to said vibration conductive planar surface with said first foot, and said user can generate said second musical sound with said contact to said vibration conductive planar surface with said second foot.

4. The sound generating apparatus of claim 3, additionally comprising:

said first portion having a first forward portion for receiving said contacts from a toe end of said first foot, and having a first rearward position for receiving said contacts from a heel end of said first foot;

said first electroacoustic transducer converting vibrations from said contact from said toe end of said first foot, to said first electronic signal;

said first electroacoustic transducer converting vibrations from a said contact by said heel end of said first, to a third said electronic signal;

said second portion having a second forward portion for receiving said contacts from a toe end of said second foot, and having a first rearward portion for receiving said contacts from a heel end of said second foot;

said second electroacoustic transducer converting vibrations from contact from said toe end of said second, to said second electronic signal;

said second electroacoustic transducer converting vibrations from a said contact from said heel end of said second foot, to a fourth said electronic signal;

said first electronic signal and said second electronic signal and said third electronic signal and said fourth electronic signal being communicated to said electronic sound generating system, for producing a first musical sound correlating to said first electronic signal, and producing a second musical sound correlating to said second electronic signal, and producing a third musical sound correlating to said third electronic signal, and producing a fourth musical sound correlating to a fourth electronic signal; and wherein said user can generate any of said first, second, third, or fourth musical sounds by a said contact of said first foot or said second foot with said vibration conductive planar surface.

5. An acoustic instrument for detecting an impact of a foot of a musician due to footfall or tap, the acoustic instrument comprising:

a vibration conductive surface which vibrates in response to the musician imparting the impact of the foot upon the vibration conductive surface, the vibration conductive surface configured to support the musician's weight; and an electroacoustic transducer in vibrational communication with the vibration conductive surface, the electroacoustic transducer configured to detect a waveform of a mechanical vibration conducted through the vibration conductive surface caused by the impact of the foot, the electroacoustic transducer converting the mechanical vibration into an electrical signal;

wherein the electrical signal is transmitted to a sound creation component which produces an amplified sound which correlates to the electrical signal.

6. The acoustic instrument of claim 5 wherein the electroacoustic transducer is a piezoelectric sensor.

7. The acoustic instrument of claim 5 further comprising a second electroacoustic transducer in vibrational communication with the vibration conductive surface and spaced apart from the electroacoustic transducer.

8. The acoustic instrument of claim 7 wherein the electroacoustic transducer is at least partially mechanically isolated from the second electroacoustic transducer, the second electroacoustic transducer converting the mechanical vibration into a second electrical signal.

9. The acoustic instrument of claim 7 further comprising a third electroacoustic transducer and a fourth electroacoustic transducer each in vibrational communication with the vibration conductive surface, the third electroacoustic transducer being spaced apart from the fourth electroacoustic transducer, the third electroacoustic transducer and the fourth electroacoustic transducer being spaced apart from the electroacoustic transducer and the second electroacoustic transducer.

10. The acoustic instrument of claim 5 further comprising an underlying surface spaced apart and beneath the vibration conductive surface defining a chamber between the vibration conductive surface and the underlying surface, the electroacoustic transducer positioned within the chamber, the underlying surface adapted for positioning on a support surface.

11. The acoustic instrument of claim 10 wherein the chamber is divided into a first chamber and a second chamber separated by dampening material, the electroacoustic transducer being positioned within the first chamber and the second electroacoustic transducer being positioned within the second chamber, the second electroacoustic transducer converting the mechanical vibration into a second electrical signal.

12. The acoustic instrument of claim 5 wherein the vibration conductive surface is minimally sized to accommodate both feet of the musician with additional space to step side-to-side, to step forward, and to step back from a central foot position.

* * * * *